US011278141B2

(12) United States Patent
Fox et al.

(10) Patent No.: US 11,278,141 B2
(45) Date of Patent: Mar. 22, 2022

(54) GARMENT AND HOOD HANGER

(71) Applicants: Laura Fox, Langley (CA); Keith Fox, Langley (CA)

(72) Inventors: Laura Fox, Langley (CA); Keith Fox, Langley (CA)

(73) Assignee: HALO HANGERS LTD., Langley (CA)

( * ) Notice: Subject to any disclaimer, the term of this patent is extended or adjusted under 35 U.S.C. 154(b) by 0 days.

(21) Appl. No.: 15/865,048

(22) Filed: Jan. 8, 2018

(65) Prior Publication Data

US 2019/0208941 A1 Jul. 11, 2019

(51) Int. Cl.
*A47G 25/20* (2006.01)

(52) U.S. Cl.
CPC ..... *A47G 25/20* (2013.01)

(58) Field of Classification Search
CPC ..... A47G 25/20; A47G 25/447; A47G 25/14
See application file for complete search history.

(56) References Cited

U.S. PATENT DOCUMENTS

| | | | | |
|---|---|---|---|---|
| 1,758,932 A | | 5/1930 | Carter | |
| 2,151,621 A | | 3/1939 | Silverman | |
| 2,210,344 A | | 8/1940 | Sheinaus | |
| 2,529,296 A | * | 11/1950 | Kay | A47G 25/24 223/88 |
| D253,447 S | | 11/1979 | Tully | |
| D278,866 S | | 5/1985 | Rieser | |
| D279,051 S | | 6/1985 | Shockley | |
| D279,527 S | | 7/1985 | Peterson | |

(Continued)

FOREIGN PATENT DOCUMENTS

| | | |
|---|---|---|
| CN | 2328284 | 7/1999 |
| CN | 103519651 | 1/2014 |

(Continued)

OTHER PUBLICATIONS

International Searching Authority, The International Search Report and the Written Opinion of the International Searching Authority, or the Declaration, International Application No. PCT/CA2018/050014, Filed Jan. 8, 2018, 11 pages, Receiving Office—Canadian Intellectual Property Office.

*Primary Examiner* — Clinton T Ostrup
*Assistant Examiner* — Andrew Wayne Sutton
(74) *Attorney, Agent, or Firm* — Richard D. Okimaw

(57) ABSTRACT

An apparatus for hanging a garment comprising a vertical suspension member hangable from a body, a garment support member suspended from the suspension member, the garment support member extending laterally from opposed sides of the suspension member; and an arcuate hood support member extending between first and second ends and having a midpoint therebetween, wherein the first and second ends of the hood support member are secured to the garment support member and wherein the midpoint of the hood support member is cantilevered upward from the garment support member. A method for hanging a garment comprising providing an apparatus for hanging a garment, positioning a shoulder portion of the garment on the garment support member with the suspension member extending above the shoulder portion, positioning a hood on the hood support member and hanging the apparatus on a support.

12 Claims, 5 Drawing Sheets

(56) References Cited

U.S. PATENT DOCUMENTS

| | | | | |
|---|---|---|---|---|
| D283,376 | S | 4/1986 | McConnell | |
| 4,638,931 | A | 1/1987 | Rieser | |
| 5,022,569 | A | 6/1991 | Beaulieu | |
| 5,038,979 | A | 8/1991 | Traylor | |
| D342,387 | S | 12/1993 | Bro | |
| 5,480,075 | A * | 1/1996 | Robinson | A47G 25/16 211/115 |
| 5,772,049 | A * | 6/1998 | Randone | A47F 7/06 211/30 |
| D398,159 | S | 9/1998 | Garrett | |
| D411,051 | S | 6/1999 | Hales | |
| 6,454,145 | B1 * | 9/2002 | Russ | A47G 25/20 223/85 |
| D481,545 | S | 11/2003 | Strouts | |
| D498,597 | S | 11/2004 | Ortega | |
| D498,936 | S | 11/2004 | Gouldson | |
| 6,978,904 | B1 * | 12/2005 | Lam | A47G 25/0671 211/1 |
| D546,076 | S | 7/2007 | Foreman | |
| D591,061 | S | 4/2009 | Patel | |
| 2009/0206113 | A1 | 8/2009 | Lee | |
| 2016/0220044 | A1 | 8/2016 | Klermund | |
| 2017/0340154 | A1 * | 11/2017 | Jones | A47G 25/0614 |

FOREIGN PATENT DOCUMENTS

| | | |
|---|---|---|
| JP | 2003126596 | 5/2003 |
| JP | 3122868 | 6/2006 |
| JP | 3168642 | 6/2011 |
| JP | 2011182979 | 9/2011 |
| JP | 2012066039 | 4/2012 |
| JP | 6083630 | 2/2017 |

* cited by examiner

Figure 2
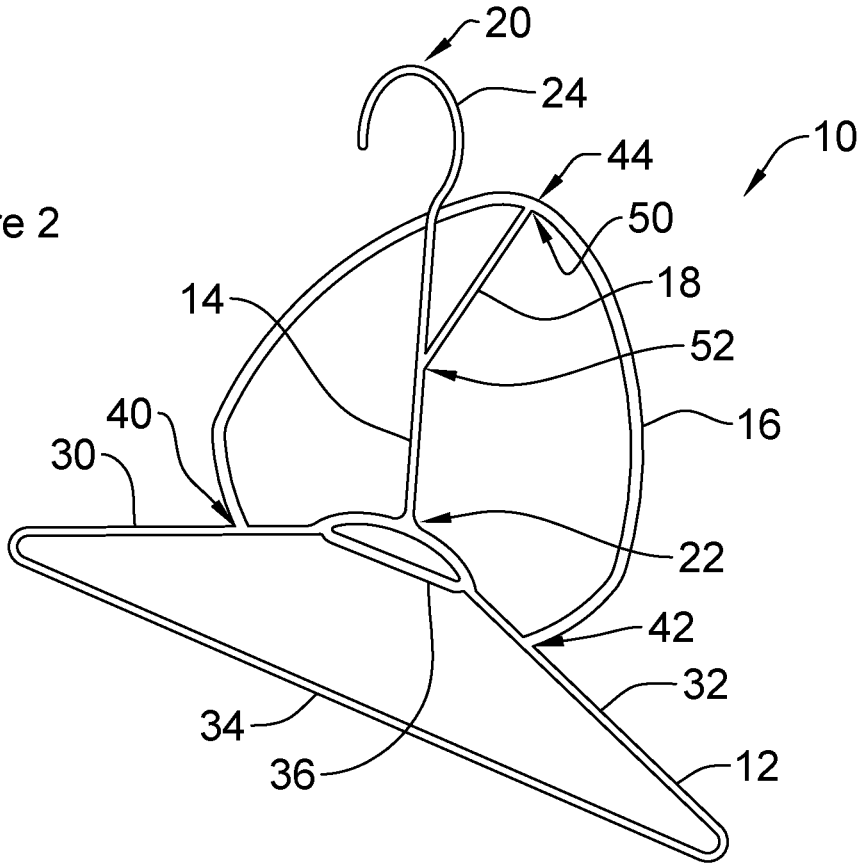
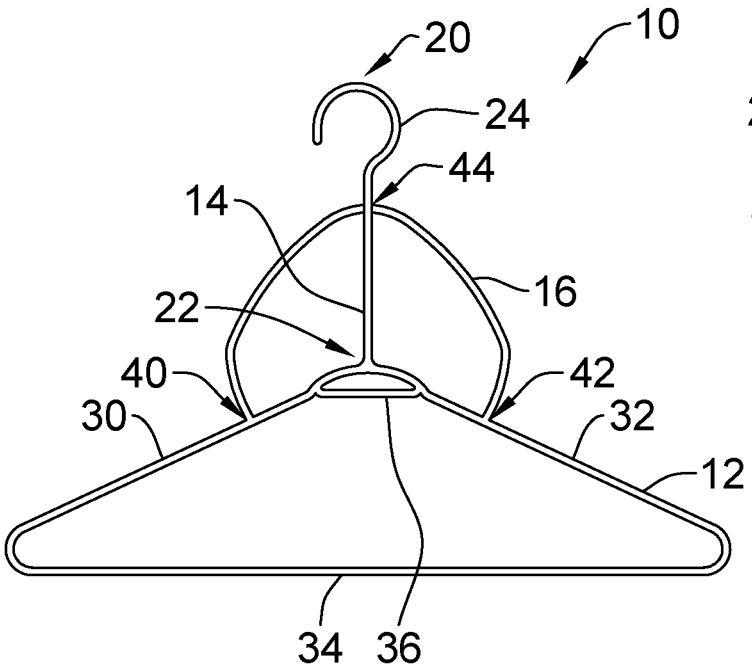
Figure 3
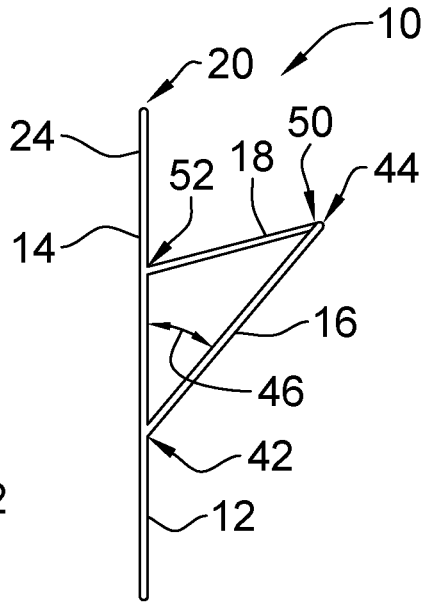
Figure 4

Figure 5
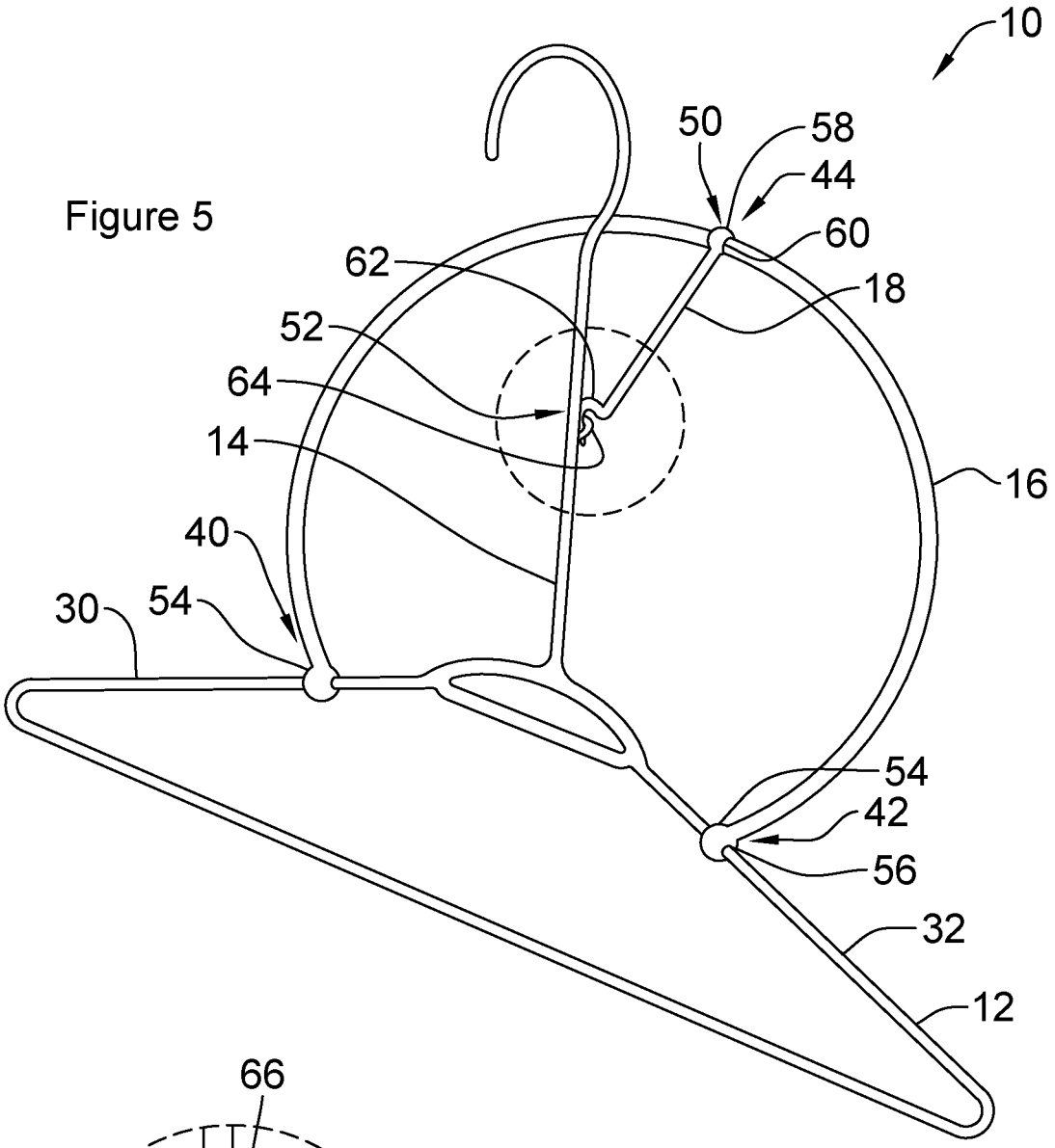
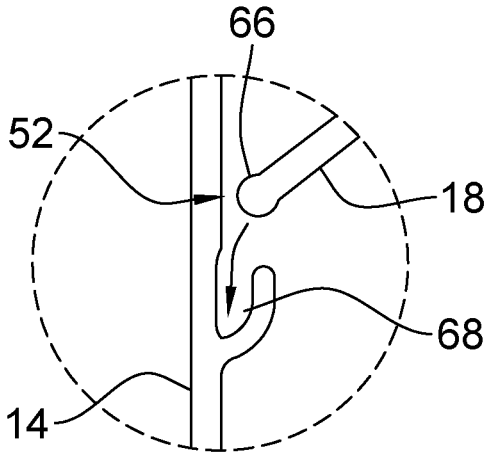
Figure 6

Figure 9
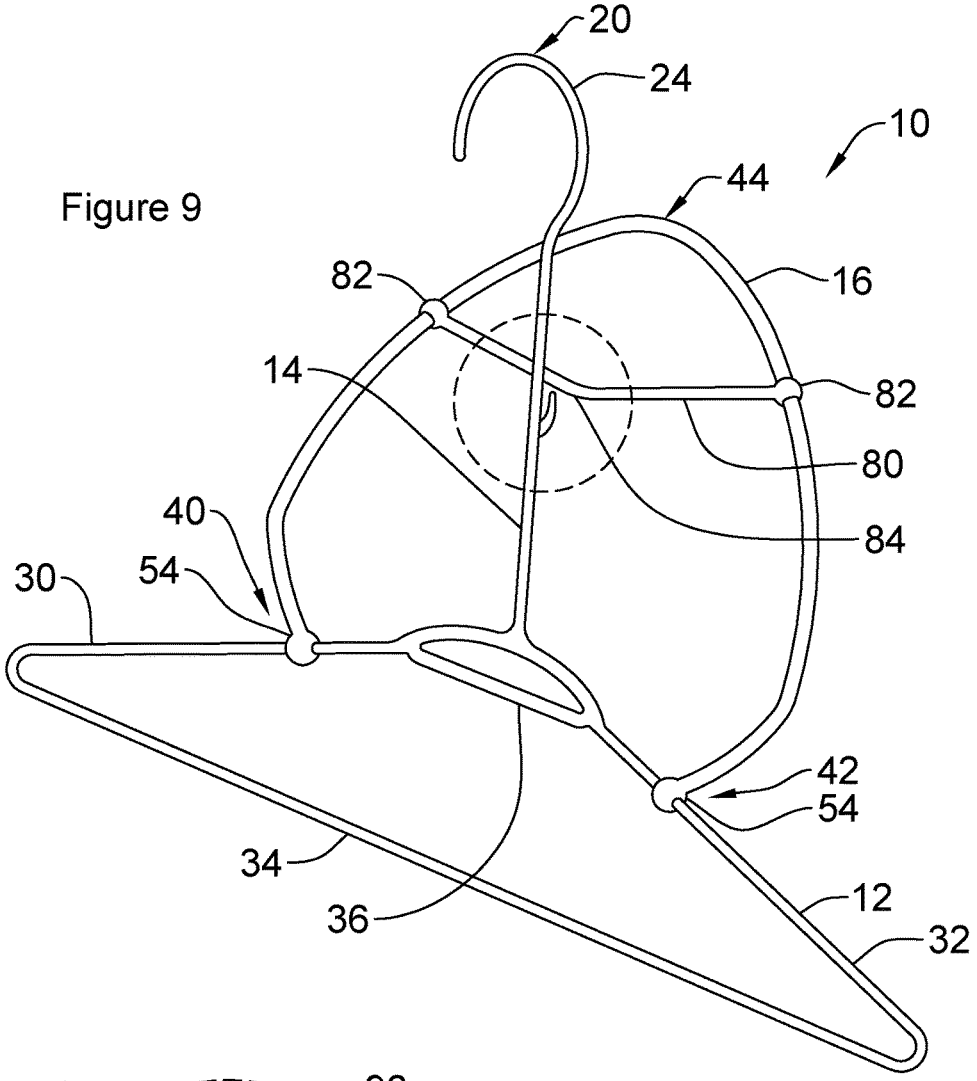
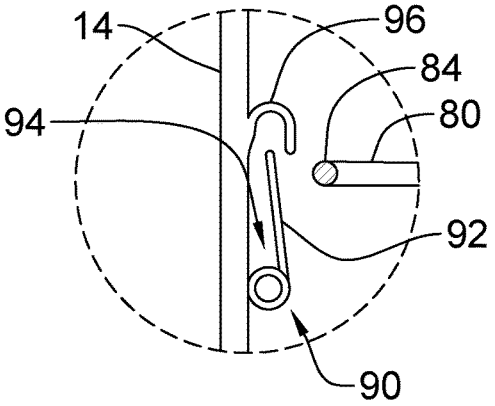
Figure 10

GARMENT AND HOOD HANGER

BACKGROUND OF THE INVENTION

1. Field of Invention

The present invention relates generally to garment hangers and in particular to a hanger providing support to an upper body garment and a hood.

2. Description of Related Art

Many upper body garments such as sweaters, sweatshirts, jackets, hoodies or coats with attached hoods must be hung to dry following laundering to prevent shrinkage or damage to the garment material, as per the manufacturer's laundering instructions. Alternately, a user may wish to hang these clothing items to dry to save the energy consumption of a dryer. When these items are hung to dry on a typical clothing hanger, the hood hangs down from the neck area of the garment unsupported, and thus airflow around the hood is restricted. This can prevent the hood from fully drying or increase drying time, potentially resulting in a malodor within the hood. Without support to the hood, it may lose its original shape, and result in unwanted wrinkles. An additional difficulty with hooded garments is that the hood increases the depth of the hung garment and therefore also increases the closet space required for storage thereof.

Hangers have been developed to support a variety of upper body garments with accessories, such as U.S. Pat. No. 2,529,296 to Kay. This style of hanger provides support to a coat with a separate hat or cap, but is unable to provide support to an attached hood.

SUMMARY OF THE INVENTION

According to a first embodiment of the present invention there is disclosed an apparatus for hanging a garment comprising a vertical suspension member hangable from a body, a garment support member suspended from the suspension member, the garment support member extending laterally from opposed sides of the suspension member; and an arcuate hood support member extending between first and second ends and having a midpoint therebetween, wherein the first and second ends of the hood support member are secured to the garment support member and wherein the midpoint of the hood support member is cantilevered upward and away from the garment support member.

The hood support member may be rigidly fixed to the garment support member. The apparatus may further comprise a crossbar extending between the vertical support member and the hood support member. The first end of the crossbar may extend from the midpoint of the hood support member. The crossbar may extend from opposed sides of the hood support member wherein a midpoint of the crossbar is engageable upon the vertical support member.

The first end of the crossbar may be fixed to the hood support member and the second end of the crossbar may be fixed to the suspension member. The first end of the crossbar may be rotatably supported by the hood support member and the second end of the crossbar may be selectably securable to the suspension member. The second end of the crossbar may include a hook. The suspension member may include a hook receiver. The hood support member may be pivotably supported by the garment support member at the first and second ends of the hood support member.

The garment support member may angle down relative to horizontal from the suspension member. The garment support member may be formed of a material selected from a group consisting of wood, metals and plastic composites.

According to a further embodiment of the present invention there is disclosed a method for hanging a garment comprising positioning a shoulder portion of the garment on a garment support member suspended from a vertically extending suspension member, the suspension member being hangable from a body, the garment support member extending laterally from opposed sides of the suspension member. The method further comprises positioning a hood of the garment on a hood support member, the hood support member extending between first and second ends and having a midpoint therebetween, wherein the first and second ends of the hood support member are secured to the garment support member and wherein the midpoint of the hood support member is cantilevered upward from the garment support member and hanging the suspension member from a body on a support.

The method may further comprise rotating a first end of a crossbar about the hood support member such that a second end of the crossbar is positioned proximate to the suspension member and securing the second end of the crossbar to the suspension member Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

FIG. 2 is a perspective view of the apparatus of FIG. 1.

FIG. 3 is a front view of the apparatus of FIG. 1.

FIG. 4 is a side view of the apparatus of FIG. 1.

FIG. 5 is a perspective view of a further embodiment of the present invention with a hook and eye crossbar attachment.

FIG. 6 is a detailed side view of an alternate attachment method for the crossbar.

FIG. 9 is a perspective view of an apparatus for hanging a garment according to a further embodiment of the present invention.

FIG. 10 is a detailed side view of the attachment mechanism for the apparatus of FIG. 9.

DETAILED DESCRIPTION

Figure 1:
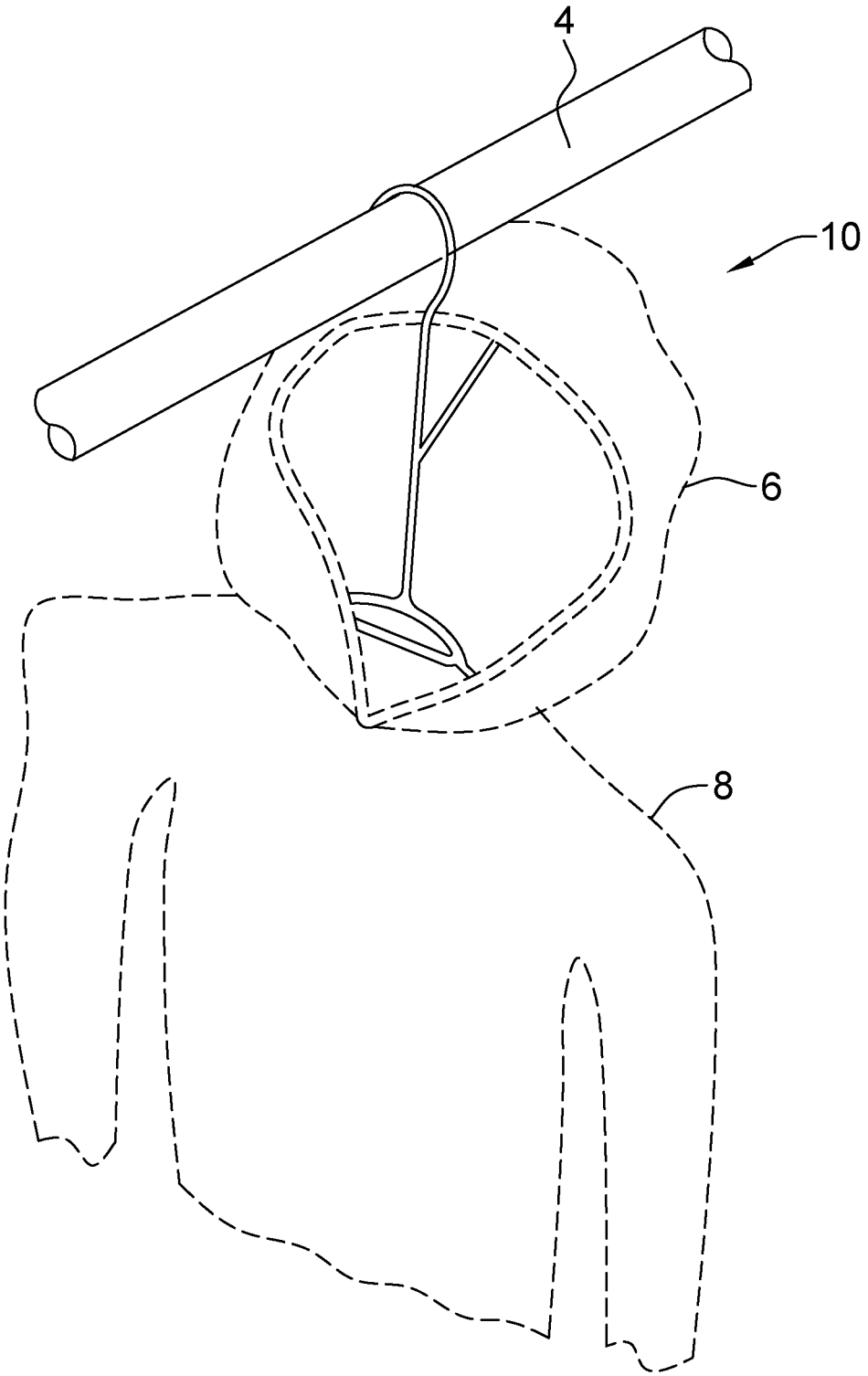
FIG. 1 is a perspective view of an apparatus for hanging a garment with a supported hooded garment thereon according to a first embodiment of the present invention.

Referring to FIG. 1, an apparatus for hanging a garment according to a first embodiment of the invention is shown generally at 10. The apparatus 10 is hung from a support, such as a rod 4, and supports a garment 8 having a hood 6.

Referring now to FIGS. 2 to 4, the apparatus 10 comprises a garment support member 12 suspended from a vertical suspension member 14 with an arcuate hood support member 16 and an optional crossbar 18 thereon.

The vertical suspension member 14 extends between upper and lower ends, 20 and 22, respectively and includes an arcuate hook 24 at the upper end 20 so that it may be supported by a rod 4, as illustrated in FIG. 1. Although the vertical suspension member 14 includes a hook 24 in the present embodiment of the invention, it will be appreciated that other fastener methods may be useful, as well, such as, by way of non-limiting example, a ball or clip securable to a slotted loop or other object, as is commonly known.

The garment support member 12 includes downward sloped first and second side members 30 and 32 extending laterally from opposed sides of the suspension member 14 at the lower end 22 with an optional lower crossmember 34. The lower crossmember 34 is commonly known with wire-frame and plastic hangers, although it will be appreciated that the lower crossmember 34 may be omitted for sturdy garment support member 12 materials such as, by way of non-limiting example, some plastics, composites or wood products. An optional upper crossmember 36 extends between the first and second side members 30 and 32 proximate to the lower end 22 of the suspension member 14. Although the first and second side members 30 and 32 are illustrated as downward sloped, it will be appreciated that horizontal side members 30 and 32 may be used, as well, without the upper or lower crossmembers 36 and 34.

The hood support member 16 extends between first and second ends, 40 and 42, respectively, with a midpoint 44 therebetween at the apex. As illustrated in FIGS. 1-3, the hood support member 16 may have a widest portion between the midpoint 44 and the first and second ends 40 and 42 with a substantially triangular shape between the widest portion and the midpoint 44 so as to conform to the shape of a hood. It will also be appreciated that other shapes, such as by way of non-limiting example, circular, as illustrated in FIG. 5, or oval may also be utilized. As illustrated in FIGS. 1 through 3, the hood support member 16 is fixed to the garment support member 12, with the first end 40 extending from the first side member 30 and the second end 42 extending from the second side member 32 and the midpoint 44 cantilevered upward from the garment support member 12. The hood support member 16 is cantilevered at a cantilever angle 46 from the garment support member 12 and vertical suspension member 14, as illustrated in FIG. 4. The cantilever angle 46 may be such as, by way of non-limiting example, in the range of 20 to 45 degrees. The hood support member 16 may be fabricated using materials such as, by way of non-limiting example, wire, plastic, composites or wood products or any other commonly known material. The hood support member 16 may also include a coating layer to provide cushioning or grip to the garment, as is commonly known. It will also be appreciated that the apparatus 10, including hood support member 16, may be provided in any required size as depending upon the size of the garment that it intended to be hung thereon, such as by way of non-limiting example, adult or child sized.

As illustrated in FIGS. 2 and 4, the optional crossbar 18 extends between first and second ends, 50 and 52, respectively. The first end 50 is secured to the midpoint 44 of the hood support member 16 and the second end 52 is secured to the vertical suspension member 14. The crossbar 18 provides additional support to the hood support member 16 such that it may support the weight of a hood 6. It will be appreciated that some hood support member 16 materials will not require the addition of the crossbar 18.

Figure 7:
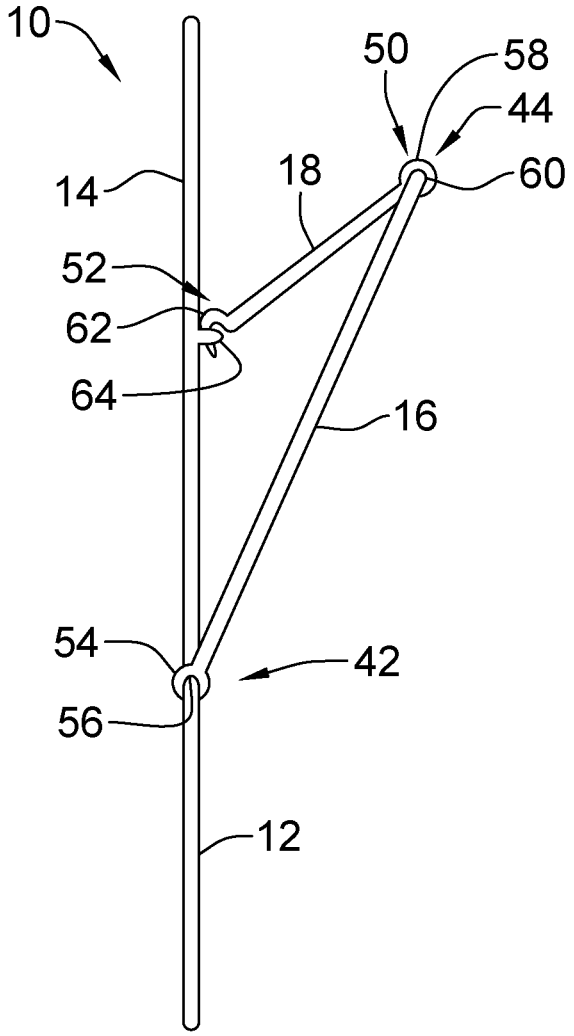
FIG. 7 is a side view of the apparatus of FIG. 5 in a hood support position.

Turning now to FIGS. 5 and 7, a further embodiment of the present invention is illustrated. In this embodiment, the hood support member 16 is pivotably supported by the garment support member 12 at the first and second ends 40 and 42. The hood support member 16 includes a ball 54 at each of the first and second ends 40 and 42 with a passage 56 therethrough adapted to receive the first and second side members 30 and 32, respectively, therethrough. Similarly, the crossbar 18 includes a ball 58 at the first end 50 with a passage 60 therethrough adapted to receive the hood support member 16 therethrough at the midpoint 44. Although a ball with a passage therethrough is illustrated in the present embodiment of the invention, it will be appreciated that other rotational supports may be used, such as, by way of non-limiting example, with a wire hanger, twisting or wrapping the ends 40 and 42 of the hood support member 16 around the garment support member 12 and twisting or wrapping the end 50 of the crossbar 18 around the hood support member 16.

The second end 52 of the crossbar 18 is selectably securable to the suspension member 14. The second end 52 may include a hook 62 securable to an eye 64 on the suspension member 14, as illustrated in FIGS. 5 and 7. Although the second end 52 is illustrated with a hook in FIGS. 7 and 8, it will be appreciated that the first end 50 may also be provided with the hook while the second end is pivotally secured to the vertical suspension member 14 such that the crossbar 18 will remain secured to the vertical suspension member when not connected to the hood support member 16. FIG. 6 illustrates an alternate securement method, with a ball 66 at the second end 52 of the crossbar 18 securable within a slot 68 formed on the suspension member 14. It will be appreciated that other securement methods may be useful, as well.

Figure 8:
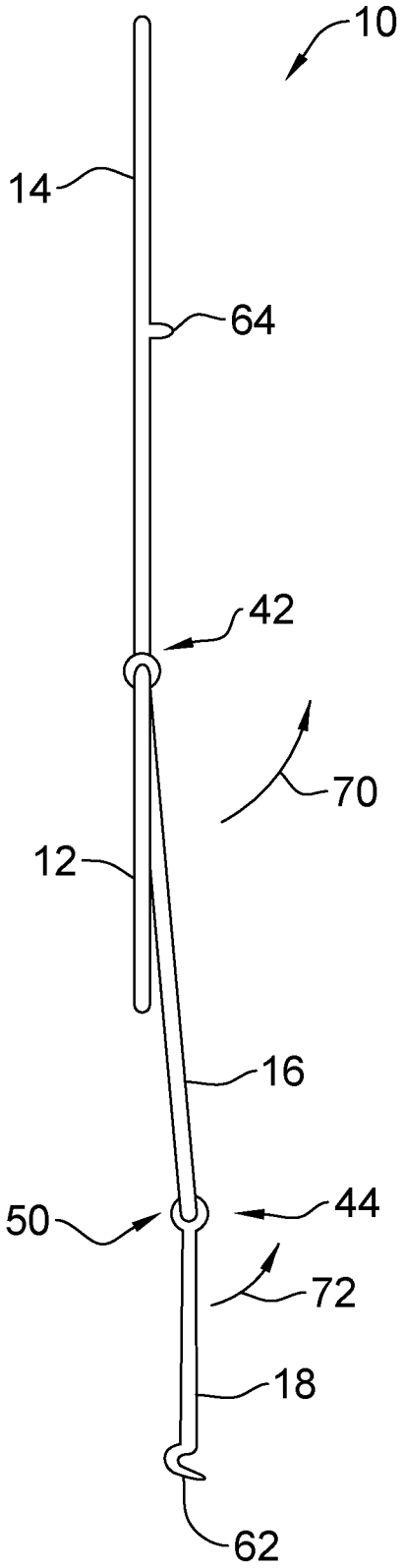
FIG. 8 is a side view of the apparatus of FIG. 5 in a released position.

Turning now to FIGS. 7 and 8, the apparatus of FIG. 5 is illustrated in a hood support position (FIG. 7) and in a released position (FIG. 8). To prepare the apparatus 10 to receive and support a garment 8 with a hood 6, the hood support member 16 is pivoted about the first and second ends 40 and 42, rotating the hood support member 16 upwards in a direction indicated at 70 until the midpoint 44 is cantilevered into a position above the garment support member 12. The crossbar 18 is then rotated about the first end 50 in a direction indicated at 72. The hood support member 16 and crossbar 18 are positioned such that the hook 62 may be received within the eye 64, thereby securing the crossbar 18 in place, ready to receive a garment 8 with a hood 6. For garments without hoods, the apparatus 10 may be used in the release position, as illustrated in FIG. 8.

To position a garment 8 with a hood 6 on the apparatus 10, the garment 8 is positioned on the garment support member 12 in the support position with the shoulder portion positioned on the first and second side members 30 and 32, by means as are commonly known with standard hangers, with the suspension member 14 extending above the shoulder portion. The hood 6 is then lifted and positioned on the hood support member 16, as illustrated in FIG. 1, and the apparatus 10 is hung from a support, such as a rod 4 or a clothesline. With the hood 6 positioned on the hood support member 16, the garment material has increased exposure to air both inside and outside the hood 6, improving drying time when a freshly laundered garment is hung to dry. With the hood 6 positioned above the garment body, the bulk of the garment at and below the shoulder level is reduced, thereby allowing for an increased number of hooded garments to be hung together within, such as, by way of non-limiting example, a closet, a display rack or at a dry cleaner.

It will be appreciated that the apparatus 10 may be used to support a garment without a hood while in the support position with a separate hat supported on the hood support member 16.

Turning now to FIGS. 9 and 10 an alternative embodiment of the present invention is illustrated which includes a crossbar 80 extending from each side of the hood support member 16. The crossbar 80 extends between distal ends 82 which may be hingedly or pivotally connected to the hood support member 16 and includes a middle portion 84. The crossbar 80 may be substantially triangularly shaped so as to space the apex 44 of the hood support member 16 away from the vertical support member 14. As illustrated in FIG. 10, the middle portion 84 of the crossbar 80 may be received within a catch 90. The catch 90 may include a biased member 92 engageable upon an end stop 96 to retain the crossbar 80 within a void 94 therein.

While specific embodiments of the invention have been described and illustrated, such embodiments should be considered illustrative of the invention only and not as limiting the invention as construed in accordance with the accompanying claims.

What is claimed is:

1. An apparatus for hanging a garment comprising:

a vertical suspension member extending to a top distal end, said suspension member being hangable from a horizontally extending body;

a garment support member suspended from and at a fixed position relative to said suspension member, said garment support member extending laterally from opposed sides of said suspension member; and an arcuate hood support member extending between first and second ends and having a midpoint therebetween, wherein said first and second ends of said hood support member are secured at a fixed location to said garment support member and wherein said midpoint of said hood support member is cantilevered upward toward said top distal end of said vertical suspension member and away from said garment support member, and a crossbar extending between a middle portion said vertical support member and said midpoint of said hood support member upward toward said top distal end of said vertical suspension member and away from said garment support member, wherein said vertical suspension member has a length selected to retain said cross bar and said hood support member below said top distal end of said vertical suspension member and said body from which said apparatus is hung.

2. The apparatus of claim 1 wherein said hood support member is rigidly fixed to said garment support member.

3. The apparatus of claim 1 further comprising a crossbar extending between said vertical support member and said hood support member.

4. The apparatus of claim 3 wherein said first end of said crossbar extends from said midpoint of said hood support member.

5. The apparatus of claim 3 wherein said crossbar extends from opposed sides of said hood support member wherein a midpoint of said crossbar is engageable upon said vertical support member.

6. The apparatus of claim 3 wherein said first end of said crossbar is fixed to said hood support member and said second end of said crossbar is fixed to said suspension member.

7. The apparatus of claim 3 wherein said first end of said crossbar is rotatably supported by said hood support member and said second end of said crossbar is selectably securable to said suspension member.

8. The apparatus of claim 7 wherein said second end of said crossbar includes a hook.

9. The apparatus of claim 8 wherein said suspension member includes a hook receiver.

10. The apparatus of claim 5 wherein said hood support member is pivotably supported by said garment support member at said first and second ends of said hood support member.

11. The apparatus of claim 1 wherein said garment support member angles down relative to horizontal from said suspension member.

12. The apparatus of claim 1 wherein said garment support member is formed of a material selected from a group consisting of wood, metals and plastic composites.

* * * * *